United States Patent [19]

Gustafson

[11] Patent Number: 4,916,584

[45] Date of Patent: Apr. 10, 1990

[54] DISPLAY FOR USE IN COMBINATION WITH A BRAKE LIGHT IN THE REAR WINDOW OF AN AUTOMOBILE

[76] Inventor: Arnold B. Gustafson, 190 Cordaville Rd., Southboro, Mass. 01772

[21] Appl. No.: 331,180

[22] Filed: Mar. 31, 1989

[51] Int. Cl.[4] ..... G09F 21/04

[52] U.S. Cl. ..... 362/61; 362/458; 362/812; 40/593

[58] Field of Search ..... 362/61, 457, 458, 812, 362/80.1; 116/36, 37, 42, 43, 44, 48, 54, 62.4; 40/591, 593, 594; D20/11, 12, 13, 14, 23, 24, 30

[56] References Cited

U.S. PATENT DOCUMENTS

| | | | |
|---|---|---|---|
| 1,534,943 | 4/1925 | Gonzalez | 116/42 |
| 1,573,660 | 2/1926 | Thompson | 116/42 |
| 1,720,531 | 7/1929 | Siegel | 40/556 |
| 1,721,947 | 7/1929 | De Los Santos | 116/44 |
| 1,820,788 | 8/1931 | Failing | 40/556 |
| 2,433,469 | 12/1947 | Malmquist | 116/42 |
| 2,880,408 | 3/1959 | Sewell | 116/37 |

*Primary Examiner*—Ira S. Lazarus
*Assistant Examiner*—Richard R. Cole
*Attorney, Agent, or Firm*—Irving M. Kriegsman

[57] ABSTRACT

A display which is in the form of a sheet of transparent material having imprinted on one side thereof the upper portion of a head of an animal and having on the other side a layer of a non-permanent adhesive. The display is mounted on the rear window of an automobile, the automobile being of the type which includes a brake light on the rear window. The display is mounted on the window such that the brake light is where the nose of the animal would be located. In use, when the brakes are applied, the brake light is turned on giving the appearance that the nose intermittently lights up.

5 Claims, 1 Drawing Sheet

DISPLAY FOR USE IN COMBINATION WITH A BRAKE LIGHT IN THE REAR WINDOW OF AN AUTOMOBILE

BACKGROUND OF THE INVENTION

The present invention relates generally to displays and more particularly to a display for use with an automobile of the type having a brake light in the rear window.

Automobiles which include a brake light in the rear window have been in use now for several years.

It is commonplace to secure decal type displays on the rear window of an automobile. Such decals are permanently affixed (i.e. non-removable) and do not functionally combine with any part of the automobile.

SUMMARY OF THE INVENTION

According to this invention, a display is provided which is in the form of a sheet of transparent material having imprinted on one side thereof the upper portion of a head of an animal and having on one side a layer of an adhesive. The display is mounted on the rear window of an automobile, the automobile being of the type which includes a brake light on the rear window. The display is mounted on the window such that the brake light is where the nose of the animal would be located. In use, when the brakes are applied, the brake light is turned on, giving the appearance of a reindeer whose nose intermittently lights up.

Various features and advantages will appear from the description to follow. In the description, reference is made to the accompanying drawing which forms a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope ofthe present invention is best defined by the appended claims.

BRIEF DESCRIPTION OF THE DRAWINGS

In the drawings wherein like reference numerals represent like parts.

DETAILED DESCRIPTION OF PREFERRED EMBODIMENTS

Figure 1:
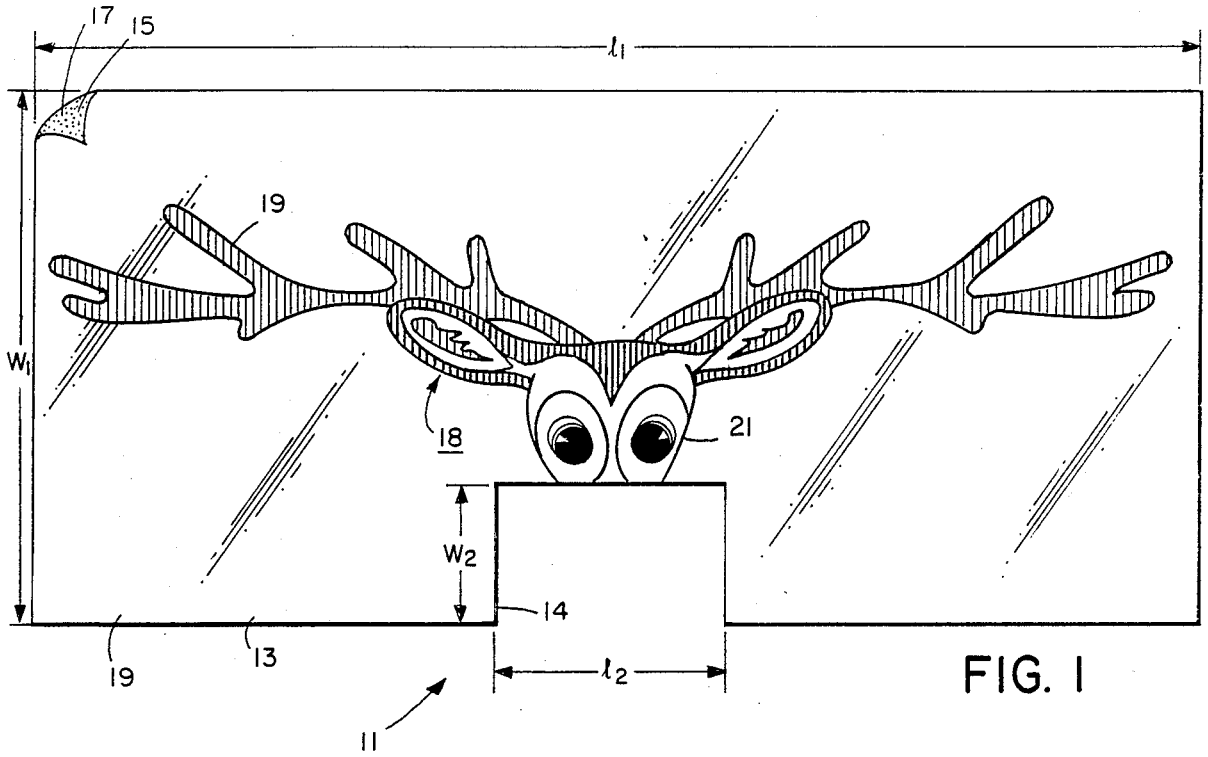
FIG. 1 is a plan view of a display constructed according to the teachings of the present invention.
Figure 2:
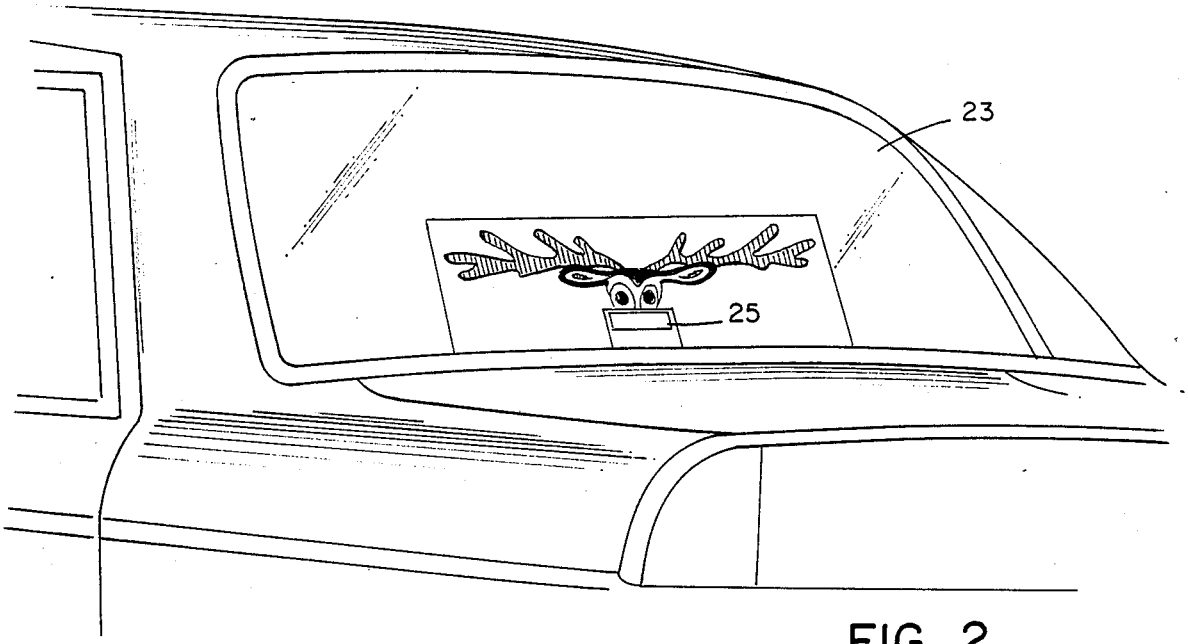
FIG. 2 is a perspective view of the display shown in FIG. 1 as mounted in the rear window of an automobile.

Referring now to the drawings there is shown in FIG. 1 a view of a display constructed according to the teachings of the present invention and identified generally by reference numeral 11.

Display 11 comprises a sheet 13 of polyester film or other suitable transparent flexible plastic material. Sheet 13 has a generally rectangular configuration, a length $l_1$ of about 24 inches, a width $W_1$ of about 10 inches and a thickness of about 0.003 inches. A rectangular slot (or cut out) 14 is formed at the bottom of sheet 13. Slot 14 has a length $L_2$ of about 7 inches and a width $W_2$ of about 5 inches. A layer of a nonpermanent adhesive 15 (a coadhesive) is on one side 17 of sheet 13. A color drawing 18 of the antlers 19 and upper portion of the head 21 of a reindeer is on the other side 21 of sheet 13. Drawing 18 is formed on sheet 13 by photo offset printing or any other suitable process. As can be seen, drawing 18 does not include the nose, south or jaw portions of the reindeer. As can also be seen, drawing 18 is positioned on sheet 13 directly above slot 14.

In use, display 11 is mounted on the rear window 23 of an automobile of the type having a brake light 25 at the bottom of the window. Display 11 is positioned on rear window 23 such that slot 14 is in registration with brake light 25. As so positioned, brake light 25 will appear to correspond to the nose portion of the reindeer and each time the brakes are applied the nose will appear to light up.

Since adhesive 15 is non permanent, display 11 can be removed from and then reinstalled on window 25 at any time, as desired.

Instead of a reindeer, drawing 18 can be of another animal or of another item or even person. Instead of applying the drawing in one side of the sheet and the adhesive to the other side of the sheet, the drawing and the adhesive can both be applied to the same side of the sheet.

In another embodiment of the invention, slot 14 is eliminated and the drawing is aligned with the bottom edge of the sheet.

The embodiment of the present invention is intended to be merely exemplary and those skilled in the art shall be able to make numerous variations and modifications to it without departing from the spirit of the present invention. All such variations and modifications are intended to be within the scope of the present invention as defined in the appended claims.

I claim:

1. A display comprising a sheet of transparent flexible plastic material having a top edge and a bottom edge, the sheet having on one side thereof directly above the bottom edge a drawing of the upper portion of the head of an animal and having on one side a layer of a non permanent adhesive, whereby the sheet may be affixed to the rear window of an automobile having a brake light in the rear window such that the brake light is aligned with the nose area portion of the head of the animal and removed from the rear window and then reinstalled at anytime, as desired.

2. The display of claim 1 and wherein the animal in a reindeer.

3. The display of claim 1 and wherein the sheet is a polyester film and wherein a slot is formed on the sheet at the bottom edge, the slot being sized to be in registration with the brake light and wherein the head of the animal is directly above the slot.

4. A display comprising:

a. a brake light, the brake light being in the rear window of an automobile, b. a sheet of transparent material mounted on the rear window, the sheet having imprinted thereon the upper portion of the head of an animal, the sheet being positioned on the window such that the brake light is in the vicinity of what would be the nose portion of the animal.

5. A method of making a display comprising:

a. providing an automobile having a brake light in the rear window, b. imprinting the upper portion of the head of an animal on a sheet of transparent plastic material, and c. mounting the sheet on the rear window such that the brake light is aligned with the nose area of the head of the animal.

* * * * *